US011267676B2

(12) United States Patent
Häderer et al.

(10) Patent No.: US 11,267,676 B2
(45) Date of Patent: Mar. 8, 2022

(54) ELEVATOR SYSTEM WITH A PROTECTIVE SCREEN

(71) Applicant: Inventio AG, Hergiswil (CH)

(72) Inventors: Johannes Häderer, Adligenswil (CH); Michael Thürig, Ebikon (CH); Stephan Hess, Emmenbrücke (CH)

(73) Assignee: INVENTIO AG, Hergiswil (CH)

( * ) Notice: Subject to any disclaimer, the term of this patent is extended or adjusted under 35 U.S.C. 154(b) by 0 days.

(21) Appl. No.: 15/733,750

(22) PCT Filed: Jun. 18, 2019

(86) PCT No.: PCT/EP2019/065957

§ 371 (c)(1),
(2) Date: Oct. 16, 2020

(87) PCT Pub. No.: WO2020/002039

PCT Pub. Date: Jan. 2, 2020

(65) Prior Publication Data

US 2021/0163259 A1 Jun. 3, 2021

(30) Foreign Application Priority Data

Jun. 28, 2018 (EP) ..... 18180434

(51) Int. Cl.
*B66B 5/00* (2006.01)
*B66B 7/06* (2006.01)
*B66B 17/12* (2006.01)

(52) U.S. Cl.
CPC ..... *B66B 5/0056* (2013.01); *B66B 7/06* (2013.01); *B66B 17/12* (2013.01)

(58) Field of Classification Search
CPC ..... B66B 5/0056; B66B 7/06; B66B 17/12; B66B 11/0005; B66B 5/0087
See application file for complete search history.

(56) References Cited

U.S. PATENT DOCUMENTS 9,505,588 B2 * 11/2016 Guillot ..... B66B 5/0056
9,908,746 B2 * 3/2018 Yu ..... B66B 11/0005
10,919,731 B2 * 2/2021 Talonen ..... B66B 5/0056
(Continued)

FOREIGN PATENT DOCUMENTS

CN 206915529 U 1/2018
CN 207061584 U 3/2018
(Continued)

*Primary Examiner* — Michael A Riegelman
(74) *Attorney, Agent, or Firm* — William J. Clemens; Shumaker, Loop & Kendrick, LLP

(57) ABSTRACT

An elevator system has a counterweight moveable in an elevator shaft for a weight equalization of an elevator car which can move in an opposite direction to the counterweight. A protective screen is arranged in a shaft pit of the elevator shaft and has a vertical portion oriented substantially parallel to a movement path of the counterweight. The protective screen prevents a person located in the shaft pit from entering the movement path of the counterweight. The protective screen has a horizontally arranged angulation, wherein an angled portion of the protective screen that adjoins the angulation extends into the projection of the counterweight in the movement direction.

9 Claims, 4 Drawing Sheets

(56) References Cited

U.S. PATENT DOCUMENTS

| | | | | |
|---|---|---|---|---|
| 2009/0183955 | A1* | 7/2009 | Gonzalez Rodil | B66B 5/0056 187/404 |
| 2017/0015525 | A1* | 1/2017 | Yu | B66B 7/021 |
| 2018/0319629 | A1* | 11/2018 | Talonen | B66B 5/0056 |
| 2018/0327218 | A1* | 11/2018 | Sudi | B66B 5/0087 |
| 2019/0241401 | A1* | 8/2019 | Davis | B66B 7/06 |
| 2021/0163259 | A1* | 6/2021 | Haderer | B66B 5/0056 |

FOREIGN PATENT DOCUMENTS

| | | | | | |
|---|---|---|---|---|---|
| JP | 2013095571 | A | | 5/2013 | |
| JP | 2013107767 | A | * | 6/2013 | |
| WO | 03082722 | A1 | | 10/2003 | |
| WO | WO-2005058739 | A2 | * | 6/2005 | B66B 5/0056 |

* cited by examiner

B - B

ELEVATOR SYSTEM WITH A PROTECTIVE SCREEN

FIELD

The invention relates to an elevator system having a protective screen shielding a counterweight.

BACKGROUND

Elevator systems usually comprise an elevator shaft, an elevator car and a counterweight. The elevator shaft has a shaft head at its upper end and a shaft pit at its lower end. The elevator car and the counterweight are arranged inside the elevator shaft, the counterweight usually being arranged on a shaft wall of the elevator shaft and the elevator car and the counterweight being movable in opposite directions to one another. This means that the counterweight is lowered along its movement path into the shaft pit when the elevator car is moved to an uppermost position within the elevator shaft and vice versa. During maintenance of the elevator system, such a lowering of the elevator car or the counterweight can endanger the safety of a service technician located in the shaft pit.

In order to protect the service technician from the counterweight coming down, a protective screen is usually installed that blocks access to the counterweight's movement path. WO 03 08 2722 shows such a protective screen, which is arranged adjacent to the movement path of the counterweight in such a way that under no circumstances can a person be injured by the moved counterweight in the shaft pit. The disadvantage is that this protective screen has large dimensions and is correspondingly expensive.

SUMMARY

It is therefore an object of the invention to implement a more economical protective screen.

This object is achieved by an elevator system having a counterweight that can be moved in an elevator shaft, which counterweight can be provided for a weight compensation of an elevator car that can be moved in the opposite direction to the counterweight, and a protective screen which is arranged or can be arranged in a shaft pit of the elevator shaft and has a vertical portion, the vertical portion being oriented substantially parallel to a movement path of the counterweight, the protective screen being provided to prevent a person in the shaft pit from entering the movement path of the counterweight, characterized in that the protective screen has a horizontally arranged angulation, wherein an angled portion of the protective screen adjoining the angulation extends into the projection of the counterweight that is available in the movement direction.

The invention is based on the knowledge that a largest possible dimensioned space which can be occupied by the counterweight along its movement path has its lowest limit several meters above the shaft bottom. In particular, this largest possible dimensioned space, accordingly, also encloses that position of the counterweight which can be assumed by the counterweight in its lowermost position adjacent to at least one maximally compressed bumper device. The shaft bottom forms the lower limit of the shaft pit or elevator shaft.

Accordingly, at no time is the counterweight present beyond a substantially lowermost portion of the vertical portion, which at its lowermost point is possibly only a few centimeters from the shaft bottom. This means that said lowermost portion merely prevents a person from entering a space which cannot be directly occupied by the counterweight.

On the one hand to save material and on the other hand to prevent a person in the shaft pit from entering the movement path of the counterweight, the angled portion of the protective screen is arranged below, preferably directly below, this aforementioned largest possible dimensioned space. As an alternative to a substantially right-angle angulation, which in the case of a vertical movement path of the counterweight may require a horizontally oriented angled portion, the angulation may alternatively be formed at an acute or obtuse angle.

The movement path of the counterweight is defined in the present description by the entire space that the counterweight can occupy during normal operation of the elevator system plus the space that the counterweight occupies in a completely compressed bumper device when this bumper device is contacted.

A further development of the elevator system comprises a bumper device which is or can be arranged in the shaft pit to limit the travel of the counterweight in an emergency situation, the angled portion of the protective screen having at least one cutout through which the bumper device protrudes.

Such a bumper device is usually arranged upright in the shaft pit in the projection of the counterweight obtainable in the movement direction. This means that the bumper device that is not compressed to the maximum extent extends from the shaft bottom to within the largest possible dimensioned space which can be taken up by the counterweight along its movement path. The cutout of the angled portion of the protective screen allows the use or operation of such a bumper device, which is arranged, for example, on the shaft bottom. Alternatively, the bumper device can be attached to a frame within the shaft pit or to the guide rails.

In a further development of the elevator system, a vertical portion of the protective screen arranged parallel to the movement path of the counterweight has a maintenance cutout, preferably closable with a cover, for inspection and/or maintenance of the bumper device.

Such a maintenance cutout or window cutout allows the components of the elevator system arranged behind the protective screen to be inspected or serviced. Consequently, this also allows maintenance of any further elements of the elevator system, in particular the bumper device or an optionally present lower cable device.

In a further development of the elevator system, the angulation of the protective screen is a fold or a bend. The advantage of such a fold or such a bend is that the protective screen can be produced in a simple manner and is therefore inexpensive.

In a further development of the elevator system, the external dimensions of the angled portion of the protective screen cover at least 50% of the area projected by the counterweight in the movement direction. It is advantageous that a person located in the shaft pit cannot get into the movement path of the counterweight by reaching behind the angled portion of the protective screen.

In a further development of the elevator system, the movement path of the counterweight is arranged on a shaft wall of the elevator shaft, and the angled portion extends up to the shaft wall. Accordingly, increased safety can be achieved for service technicians who carry out maintenance work in the shaft pit. The angled portion is preferably at a distance of less than 10 cm or less than 5 cm from the shaft wall. Accordingly, the angled portion can be designed to touch the shaft wall.

In a further development of the elevator system, a vertical portion of the protective screen arranged parallel to the movement path of the counterweight extends up to a height of at least 2 m, preferably 2.5 m, above a shaft bottom of the shaft pit. In this way it can be ensured that a person located in the elevator shaft or in the shaft pit cannot get to or reach into the movement path of the counterweight over the protective screen.

DESCRIPTION OF THE DRAWINGS

The invention is explained in greater detail in the following with reference to drawings, which show.

DETAILED DESCRIPTION

Figure 1:
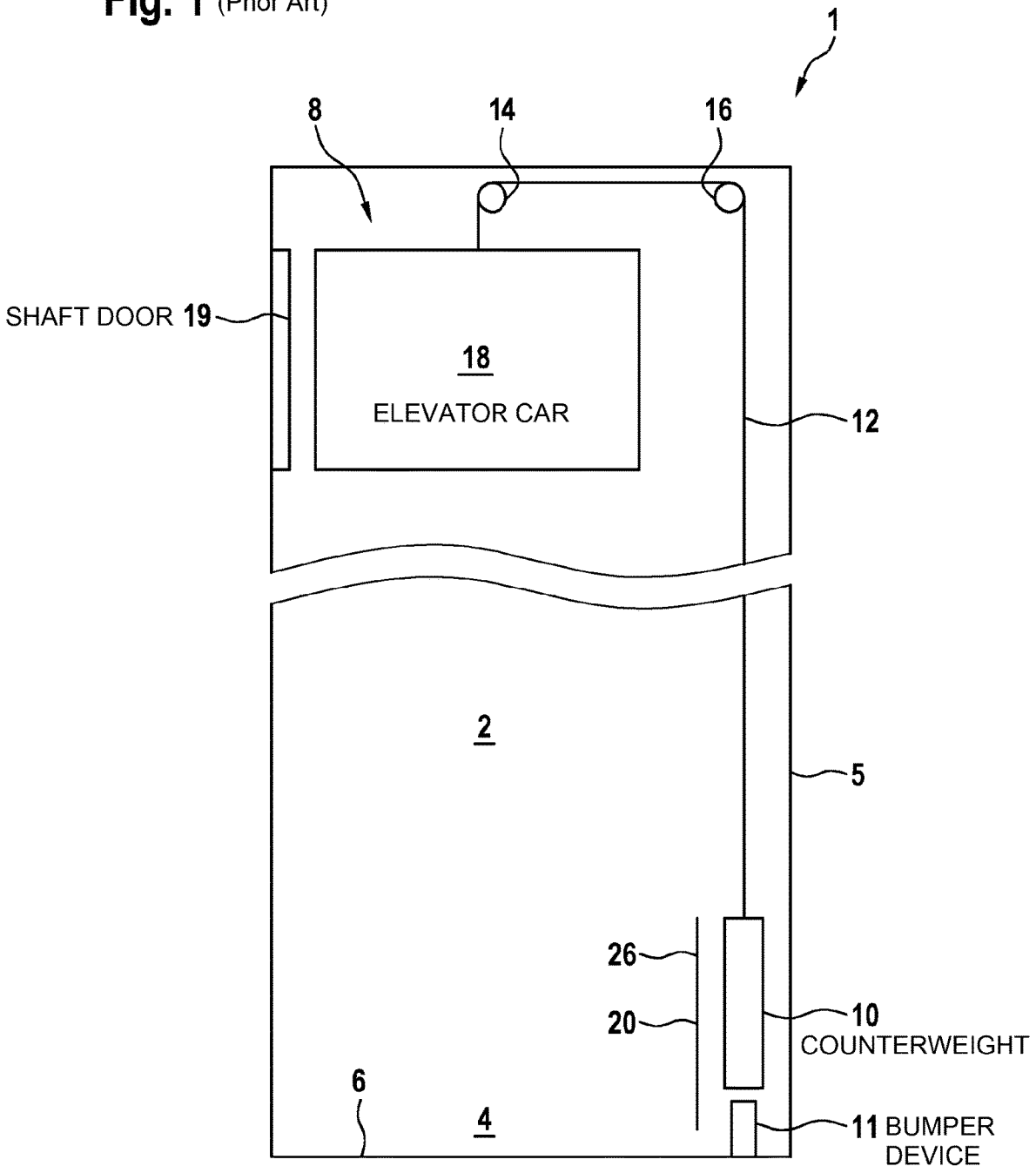
Fig. 1 (Prior Art)
FIG. 1: an elevator system having a protective screen arranged in a shaft pit according to a previously known embodiment.

FIG. 1 shows an elevator system 1 having an elevator shaft 2, an elevator car 18 and a counterweight 10. The elevator shaft 2 comprises a shaft head 8 at its upper end and a shaft pit 4 at its lower end and is usually delimited laterally by at least one shaft wall 5. In the shaft pit 4, the elevator shaft 2 is delimited by the shaft bottom 6. The elevator car 18 is arranged in the elevator shaft 2 such that it can be moved along a main orientation of the elevator shaft 2. The counterweight 10 can be moved in the opposite direction to the elevator car 18 and is arranged, for example, on the shaft wall 5. A bumper device 11 can be arranged in the shaft pit 4 below the counterweight 10, so that the movement path of the counterweight 10 is limited in an emergency situation.

A protective screen 20 is arranged in the shaft pit 4 in such a way that the movement path of the counterweight 10 is separated from the area of the shaft pit 4 which can be accessed by a service technician. The shown conventional protective screen 20 substantially consists of a vertical portion 26 oriented parallel to the movement path of the counterweight 10.

The elevator car 18 and the counterweight 10 can be connected by means of a support element 12. The support element 12 is guided over rollers 14, 16. One of these rollers 14, 16 can be designed as a drive pulley coupled to a drive motor for driving the elevator car 18 or the counterweight 10.

The elevator car 18 shown in FIG. 1 is arranged on an uppermost shaft door 19 of the elevator system 1, which is shown as an example. Corresponding to the aforementioned ability to move in opposite directions, the counterweight 10 is in a position arranged in the shaft pit 4 in which the bumper device 11 is not actuated by the counterweight 10. The counterweight 10 is preferably spaced apart from the bumper device 11 in the position shown.

Figure 2:
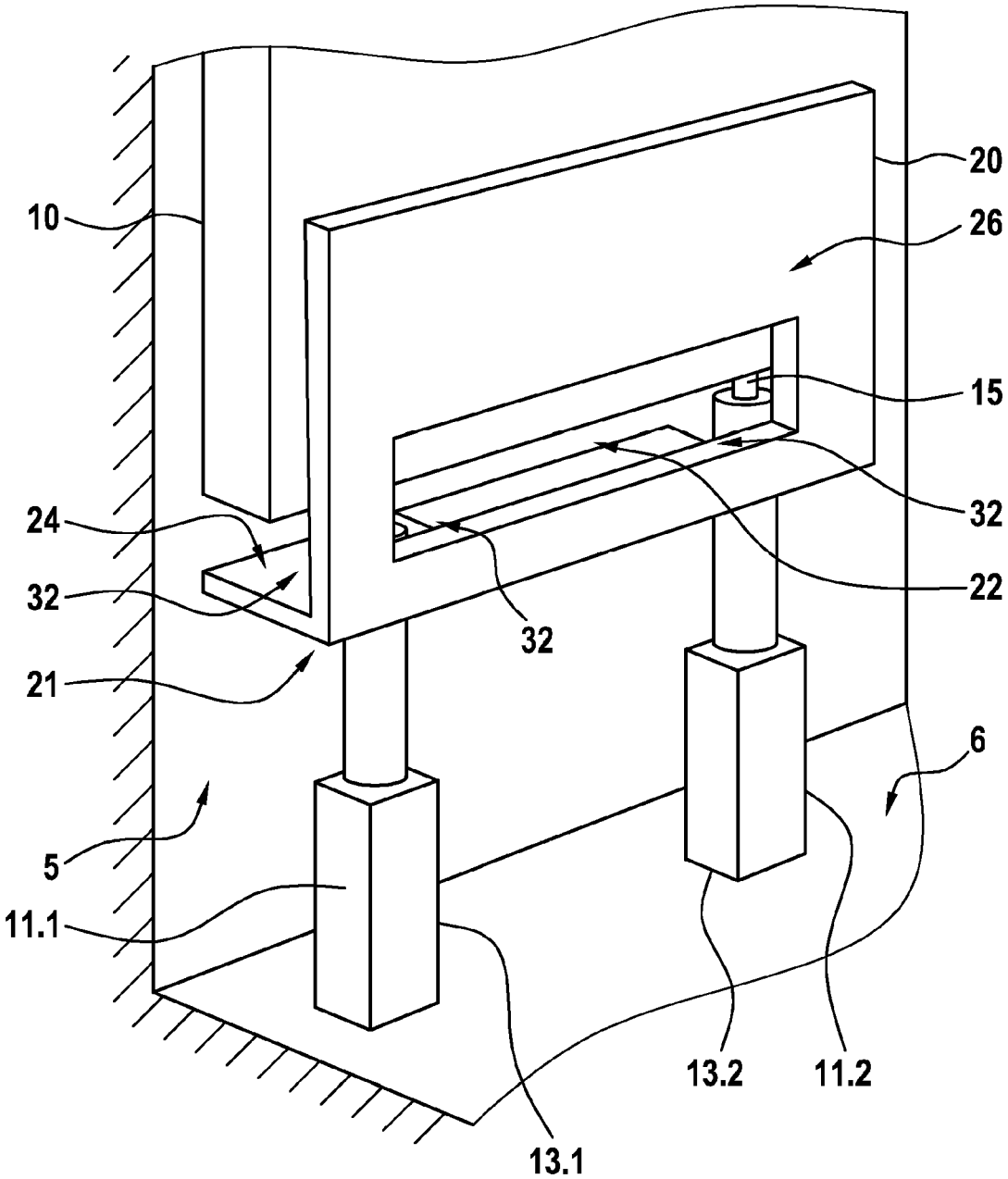
FIG. 2: a protective screen arranged in a shaft pit according to a first embodiment of the invention.
Figure 3:
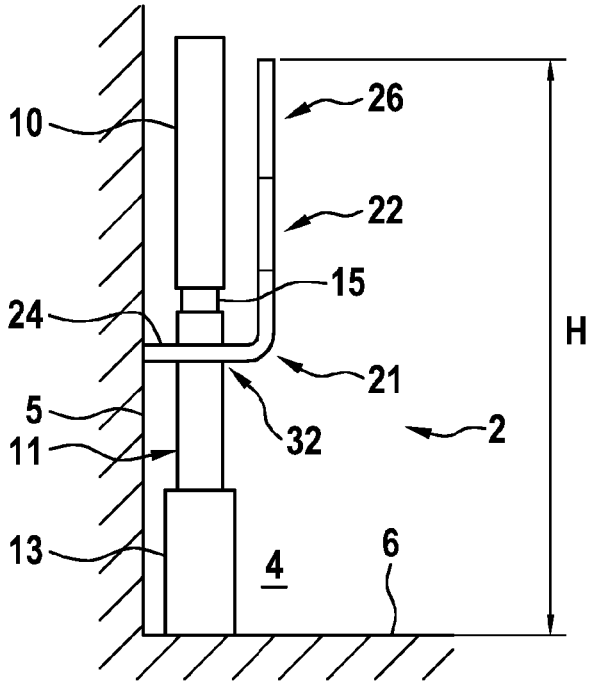
FIG. 3: a side view of the protective screen shown in FIG. 2 having a counterweight adjoining a bumper device.
Figure 4:
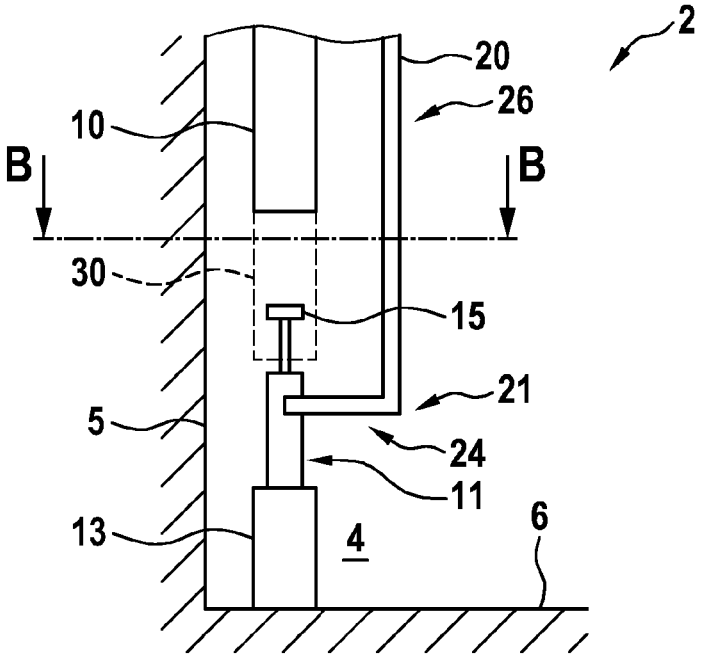
FIG. 4: a protective screen arranged in a shaft pit according to a second embodiment of the invention.
Figure 5:
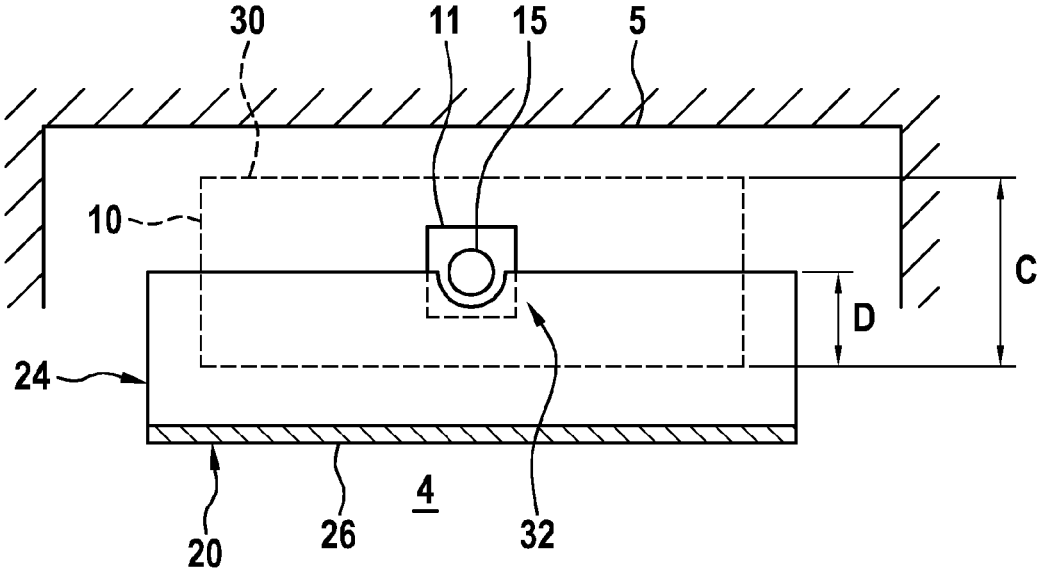
FIG. 5: a top view of the protective screen shown in FIG. 4.

FIG. 2 shows a section of a shaft pit 4 of a first elevator shaft 2 having a protective screen 20 according to a first embodiment of the invention, FIG. 3 depicting the side view of the elements of the elevator system shown in FIG. 2. FIG. 4 shows a section of a shaft pit 4 of a second elevator shaft 2 having a protective screen 20 according to a second embodiment, FIG. 5 depicting the corresponding top view according to section B-B shown in FIG. 4.

The shaft pits 4 of the two elevator shafts 2 shown in FIGS. 2 to 5 are delimited at the bottom by a shaft bottom 6 and at the side by a shaft wall 5. By way of example, at least one bumper device 11, 11.1, 11.2 is arranged upright on the shaft bottom 6. The bumper device 11, 11.1, 11.2 shown as an example has a base 13, 13.1, 13.2 and a receiving ram 15. The lower portion of the base 13, 13.1, 13.2, which has a rectangular cross section, can be made of concrete. The receiving ram 15 is provided for the counterweight 10 to contact in a shown emergency situation.

Corresponding to such an emergency situation, the counterweight 10 shown in FIGS. 2 and 3 has its lowest possible position. This means that the counterweight 10 is positioned in such a way that the receiving ram 15 of the bumper device 11, 11.1, 11.2 is maximally displaced in the direction of the shaft bottom 6 by the counterweight 10 adjoining the receiving ram 15.

Each of the protective screens 20 comprises a vertical portion 26, an angulation 21 and an angled portion 24. The vertical portion 26 extends parallel to the movement direction of the counterweight 10 and is slightly spaced apart from the counterweight 10. A correspondingly small spacing means that a service technician cannot enter the space between the vertical portion 26 and the counterweight 10.

The angulation 21 is arranged at the lower end of the vertical portion 26. The vertical portion 26 of the protective screen 20 extends from the angulation 21 up to a height H of, for example, 2.0 m, preferably up to a height H of 2.50 m, this height H being only shown or designated in FIG. 3.

The angulation 21 is preferably oriented horizontally and can be produced by folding or bending or comparable methods. An angled portion 24 is arranged on the angulation 21, which angled portion 24 can be arranged substantially parallel to the shaft bottom 6. Alternatively, the angled portion 24 can be screwed or welded, for example, to the vertical portion 26.

The angled portions 24 of the protective screens 20 shown have one or more cutouts 32 through which cutout 32 or cutouts 32 the at least one bumper device 11, 11.1, 11.2 protrudes. Each of these cutouts 32 is assigned to an individual bumper device 11, 11.1, 11.2. The wall of the cutouts 32 made in the angled portions 24 can be horizontally spaced apart from the outer dimensions of the bumper device 11, 11.1, 11.2 in such a way that an injury resulting from reaching through between the bumper device 11, 11.1, 11.2 and the angled portion 24 is rendered impossible. At least one further section (not shown) can be provided within the angled portion 24, for example, for the passage of a compensation element.

The angled portion 24 shown in FIGS. 2 and 3 extends from the angulation 21 to preferably the shaft wall 5, on which shaft wall 5 the counterweight 10 is movably arranged. The angled portion 24 is accordingly preferably spaced apart from the shaft wall 5 by a distance of less than 10 cm or less than 5 cm.

The protective screen 20, preferably the vertical portion 26, has a maintenance cutout 22 for inspection and/or maintenance of the bumper device 11. The bumper device 11, in particular its receiving ram 15 or switch of this bumper device 11, or the compensation element or a triggering device of the safety brake, to name a few examples, can be adjusted or serviced through this maintenance cutout 22.

In contrast to the angled portion 24 shown in FIGS. 2 and 3, the angled portion 24 of the protective screen 20 shown in FIGS. 4 and 5 does not extend as far as the shaft wall 5. The shown counterweight 10 has a position within the elevator shaft 2 which corresponds to an uppermost position of the elevator car (not shown) in normal operation. Accordingly, the counterweight does not contact the bumper device 11 and in particular the receiving ram 15.

A largest possible dimensioned space 30 which can be occupied by the counterweight 10 along its movement path is indicated by a dashed line. The line 30 shown in FIG. 4 within the shaft pit 6 accordingly corresponds to a lowest possible position of the counterweight 10 in an emergency situation.

The largest possible dimensioned space 30, shown in plan view in FIG. 5, corresponds to the projection of the counterweight 10 in its movement direction. The angled portion 24 of the protective screen 20 extending in the direction of the shaft wall 5 overlaps this projection of the counterweight 10 by at least 50%. This means that an overlap D of the angled portion 24 to the counterweight 10 is at least 50% of the depth C of the counterweight 10.

A percentage overlap, which results from a quotient of D over C, is without taking into account an exemplary cutout 32, which cutout 32 is made in the angled portion 24 in order to be able to position the bumper device 11 below the counterweight 10.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator system comprising:

a counterweight moveable in an elevator shaft of the elevator system for weight equalization of an elevator car moveable in an opposite direction to the counterweight; and a protective screen arranged in a shaft pit of the elevator shaft and having a vertical portion being oriented parallel to a movement path of the counterweight, the protective screen adapted to prevent a person located in the shaft pit from entering the movement path of the counterweight, wherein the protective screen has an angled portion joined to the vertical portion by an angulation, the angled portion extending into a projection of the counterweight in a direction of the movement path of the counterweight.

2. The elevator system according to claim 1 including a bumper device arranged in the shaft pit to limit a downward movement of the counterweight along the movement path, wherein the angled portion of the protective screen has at least one cutout through which the bumper device protrudes.

3. The elevator system according to claim 1 wherein the vertical portion of the protective screen has a maintenance cutout formed therein for inspection and/or maintenance of the bumper device.

4. The elevator system according to claim 3 wherein the maintenance cutout is adapted to be closable with a cover.

5. The elevator system according to claim 1 wherein the angulation is formed as a fold or a bend.

6. The elevator system according to claim 1 wherein outer dimensions of the angled portion are sized to cover at least 50% of an area projected by the counterweight in the direction of the movement path of the counterweight.

7. The elevator system according to claim 1 wherein the movement path of the counterweight is adjacent a shaft wall of the elevator shaft and the angled portion extends up to the shaft wall.

8. The elevator system according to claim 1 wherein the vertical portion of the protective screen extends up to a height of at least 2 m above a shaft bottom of the shaft pit.

9. The elevator system according to claim 1 wherein the vertical portion of the protective screen extends up to a height of 2.5 m above a shaft bottom of the shaft pit.

* * * * *